United States Patent [19]

Gillett

[11] Patent Number: 4,989,751

[45] Date of Patent: Feb. 5, 1991

[54] STORAGE TANKS

[75] Inventor: Graham Gillett, Wembley, Australia

[73] Assignee: Interlok Limited, Australia

[21] Appl. No.: 9,056

[22] Filed: Jan. 27, 1987

Related U.S. Application Data

[63] Continuation of Ser. No. 720,517, Apr. 5, 1985, abandoned.

[30] Foreign Application Priority Data

Apr. 5, 1984 [AU] Australia ..... PG4440
Aug. 10, 1984 [AU] Australia ..... PG6510

[51] Int. Cl.[5] ..... B65D 6/28; B65D 6/34; B65D 90/08

[52] U.S. Cl. ..... 220/565; 220/648; 220/686

[58] Field of Search ..... 220/1 B, 5 R, 5 A, 80

[56] References Cited

U.S. PATENT DOCUMENTS

| | | | |
|---|---|---|---|
| 783,148 | 2/1905 | Snow | 220/1 B |
| 953,827 | 4/1910 | Haas | 220/5 A |
| 1,258,538 | 3/1918 | Darley | 220/5 R |
| 1,417,617 | 5/1922 | McNeil | 220/5 R |
| 1,516,073 | 11/1924 | Blackford | 220/5 R |
| 1,826,918 | 10/1931 | Bell | 220/5 R |
| 1,984,209 | 12/1934 | Ferrone | 220/5 R |
| 2,391,374 | 12/1945 | Wickstrum | 220/1 B |
| 3,460,705 | 8/1969 | Green | 220/5 A |
| 3,880,315 | 4/1975 | Nelson | 220/1 B |

FOREIGN PATENT DOCUMENTS

| | | | |
|---|---|---|---|
| 293230 | 2/1968 | Australia | 220/5 A |
| 769184 | 8/1934 | France | 220/5 A |

*Primary Examiner*—George E. Lowrance
*Attorney, Agent, or Firm*—Reising, Ethington, Barnard, Perry & Milton

[57] ABSTRACT

The invention relates to a storage tank comprising an endless wall formed of a plurality of overlapping panel members with at least one endless support strap extending substantially horizontally around the endless wall, wherein each panel member comprises a loop having an endless support strap extending therethrough.

The invention also relates to a substantially flat panel member comprising a plurality of upright raised ribs and an integral loop arranged to receive, in use, a substantially horizontal support strap.

12 Claims, 4 Drawing Sheets

STORAGE TANKS

This application is a continuation of application Ser. No. 720,517, filed Apr. 5, 1985 now abandoned.

The present invention relates to storage tanks. Storage tanks are usually built in situ or constructed and transported to a required location. In particular large storage tanks are built in situ and often employ steel reinforced concrete. Whereas, tanks for the storage of relatively small quantities of various liquids, solids or powders are often constructed and transported to a desired location for installation and use. In general the latter form of tank may be removed and relocated for use elsewhere. However, tanks built in situ and comprising concrete are not usually intended to be relocated, nor can economically be relocated. The present invention provides a storage tank which is built in situ and may be readily dismantled and relocated. In accordance with one aspect of the present invention there is provided a storage tank comprising an endless wall formed of a plurality of overlapping panel members with at least one endless support strap extending substantially horizontally around the endless wall, wherein each panel member comprises a loop having an endless support strap extending therethrough. In accordance with a further aspect of the present invention there is provided a substantially flat panel member comprising a plurality of upright raised ribs and an integral loop arranged to receive, in use, a substantially horizontal support strap.

The present invention will now be described, by way of example, with reference to the accompanying drawings, in which.

Figure 5:
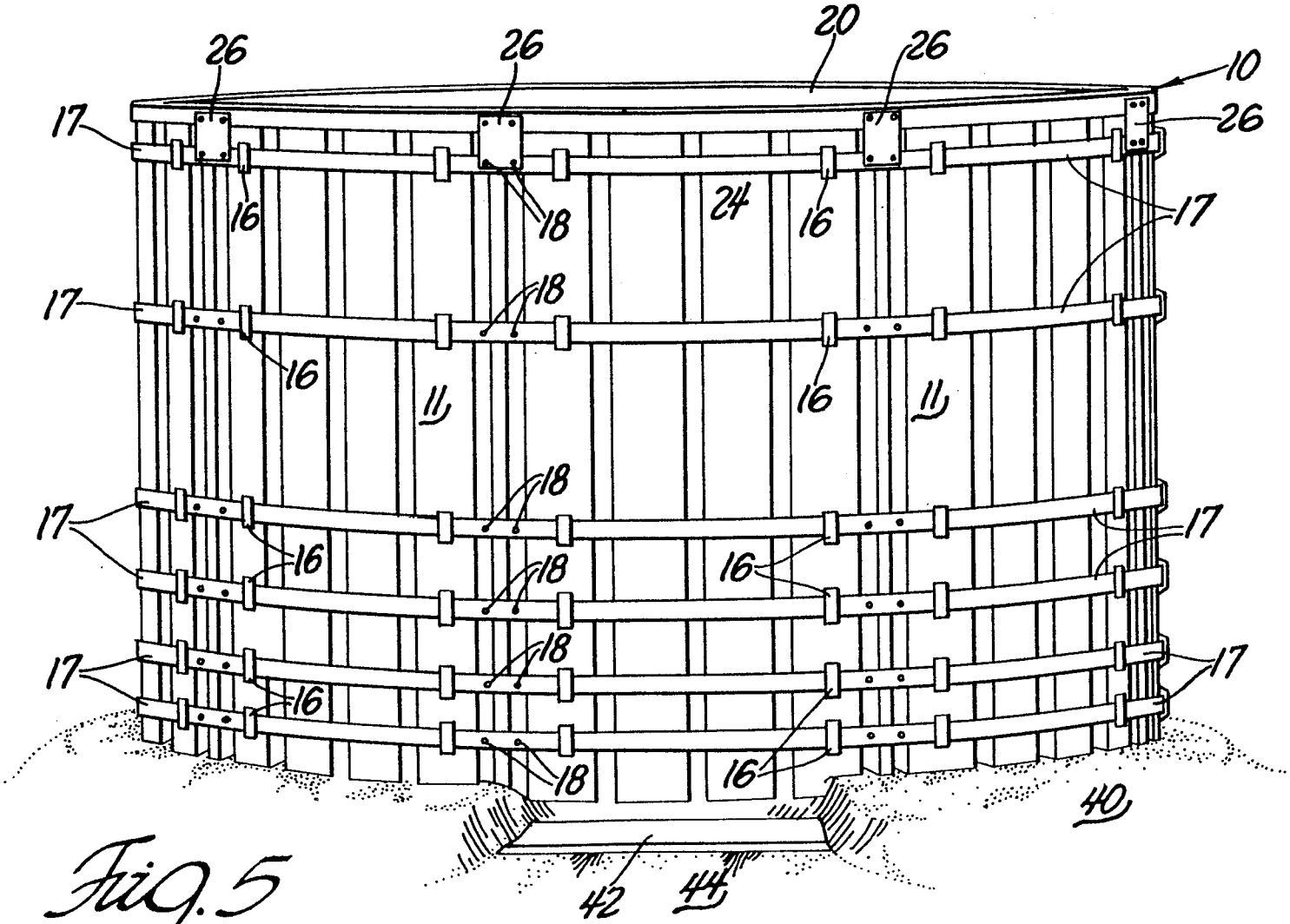
FIG. 5 is an elevated view of a storage tank in accordance with the present invention.

In FIG. 5 there is shown a storage tank 10 in accordance with the present invention, comprising a plurality of panel members 11.

Figure 1:
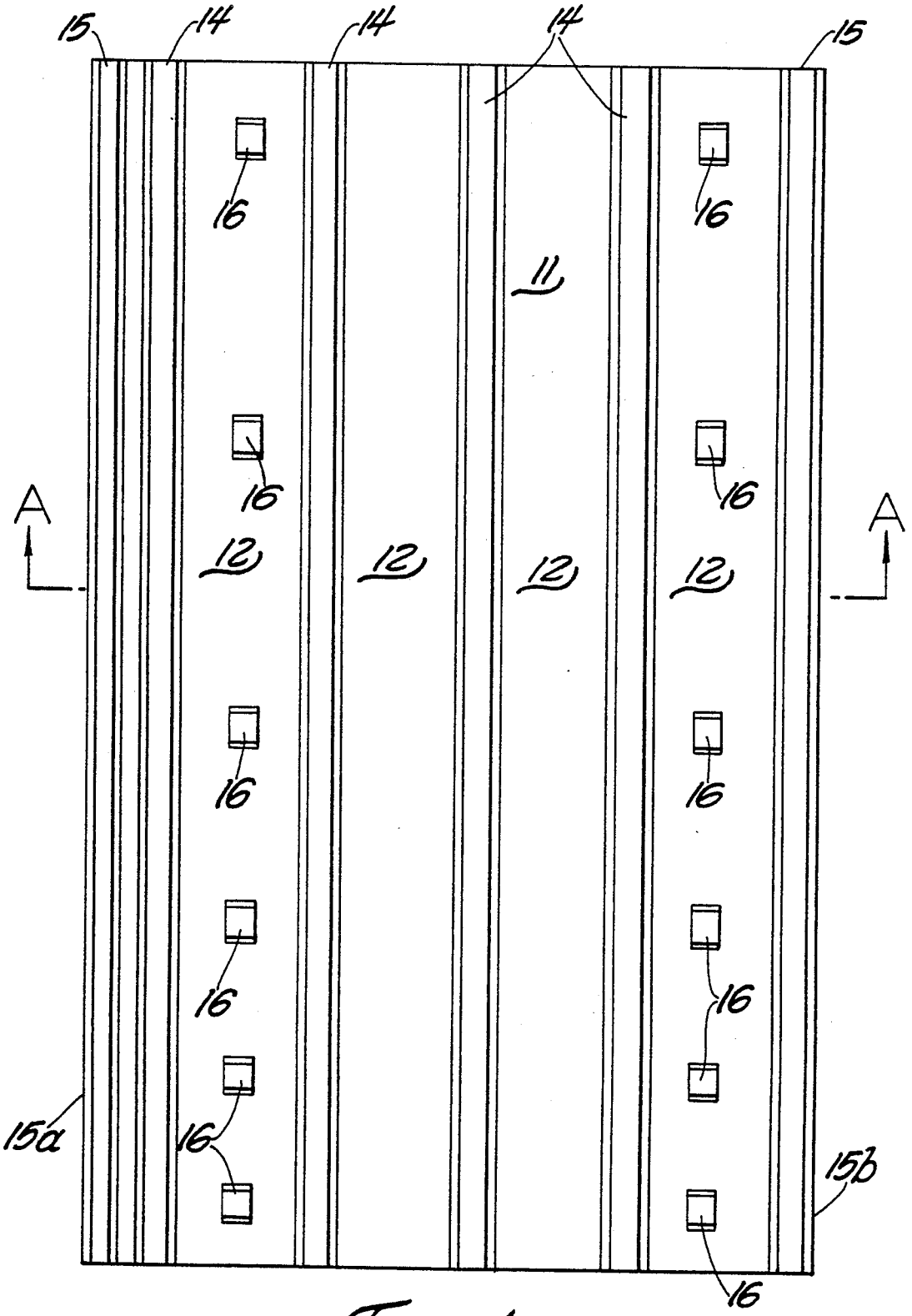
FIG. 1 is a front elevation of a panel member in accordance with the present invention.

As can be readily seen in FIG. 1, each panel member 11 comprises flat portions 12 lying in the same plane and a plurality of intermediate upright raised ribs 14 and a pair of lateral raised ribs 15 all of which project in the same direction from the plane of the flat portions 12. The raised ribs 14 and 15 are vertically disposed with a raised rib 15 at a first and a second lateral edge **15*a* and 15*b*, respectively, of the panel member 11 and further raised ribs 14 intermediately located between the first and second lateral edges 15*a* and 15*b*. The flat portions 12 are disposed between adjacent raised ribs 14 and 15. The raised ribs 14 and 15 are formed by deformation of the panel member 11, in known manner. The vertically disposed raised ribs 14 and 15 produce a vertical rigidity in the panel member 11 whilst allowing an amount of horizontal flexibility found to be suitable to allow erection of the storage tank 10** of the present invention.

Figure 3:
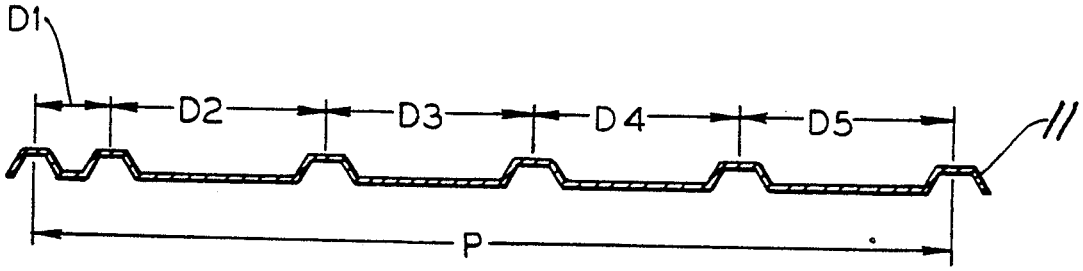
FIG. 3 is a cross sectional view of the panel member of FIG. 1 along line A—A.

As is best shown in FIGS. 1 and 3 each panel member 11 comprises a plurality of raised ribs 14 and 15, such as

6 raised ribs 14 and 15. The raised ribs 14 are equally spaced and the lateral raised ribs 15 have a lesser spacing. The panel member 11 has a width P and the distance between adjacent raised ribs 14 is designated D2, D3 and D4 respectively.

Typically the ratios $$\frac{P}{D2}, \frac{P}{D3} \text{ and } \frac{P}{D4}$$

of panel width to inter-rib distances is in the range from 3.2:1 to 5:1, preferably in the range from 4:1 to 4.5:1, for example about 4.3:1. The lateral raised ribs 15 are spaced at distances of D1 and D5 from adjacent raised ribs 14 Typically the ratio $$\frac{P}{D1}$$

of the panel width to inter-rib distance at the first lateral edge **15*a*** is in the range from from 12.5:1 to 5:1, preferably in the range from 11.5:1 to 10:1, for example about 10.8:1. Also, the ratio $$\frac{P}{D5}$$

of the panel width to inter-rib distance at the second lateral edge **15*b*** is typically in the range from 3.5:1 to 5:1, preferably in the range from 4:1 to 5:1, for example about 4.7:1.

It is envisaged that each panel member 11 could be formed from a 1200 mm wide, 2100 mm long and 0.6 mm thick sheet of metal In such a case the distance D1 is about 100 mm; D2, D3 and D4 are about 250 mm and D5 is about 230 mm.

Figure 4:
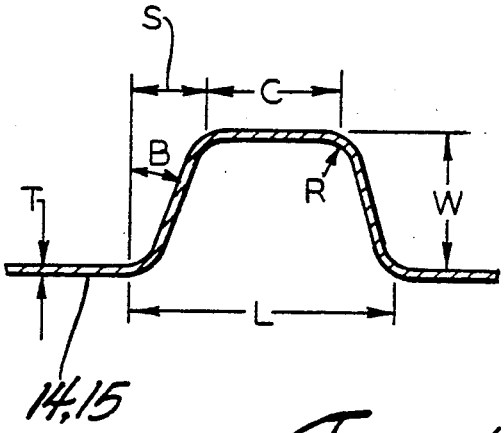
FIG. 4 is an enlarged view of a trough of the panel member shown in FIG. 3.

FIG. 4 shows a cross section of one of the raised ribs 14 or 15 of FIG. 3. The size of the raised ribs 14 or 15 suitable to form the tank 10 of the present invention is dependent upon the volume and the height of the tank. For example, a larger raised rib 14 or 15 may be needed to suit a tank of greater volume and height than that considered herein. Although, it is understood that the strength of the endless wall may be increased by other means, as described hereinafter Each raised rib 14 or 15 has a length L, a width W, a crest length C, a slope width S, a slope angle B, a thickness T and a curve radius R.

For the particular size panel member 11 described immediately hereinbefore the raised ribs 14 and 15 may have the following characteristics; the length L is about 35 mm, the width W is about 20 mm, the crest length C is about 15 mm, the slope width S is about 10 mm, the slope angle P is about 26.6°; the thickness T is about 0.6 mm and the curve radius is in the approximate range of 5 and 7 mm.

It is envisaged that a panel member 11 of dimension other than that described hereinabove could use a different number of raised ribs 14 and 15 of different characteristics. The raised ribs 15 of two adjacent panel members 11 are intended to overlap in use.

In particular a raised rib 15 of the first edge **15*a* of one panel member 11 is intended to cup, in use, into a raised rib 15 of the second edge 15*b* of an adjacent panel member 11**.

It is envisaged that a panel member 11 having a different arrangement of raised ribs 14 and 15 could be used such that more than one raised rib 14 and 15 of adjacent panel members 11 overlap.

The panel members 11 also comprise a loop means comprising loops 16 extending from the flat portions 12 and projecting in a direction opposite to that of the raised ribs 14 and 15. The loops 16 are formed by punching two equally sized parallel slits in a flat portion 12. The material between the slits is then deformed away from the flat portion 12 in a direction opposite to the raised ribs 14 and 15 to form a loop 16 of material.

The panel members 11 each comprise a plurality of such loops 16, such as 12 loops 16, arranged toward the lateral edges 15*a* and 15*b*. The loops 16 are arranged so that half are adjacent one lateral edge 15*a* or 15*b* and half adjacent the other, with corresponding loops 16 being at the same height upon the panel member 11. Conveniently, the loops 16 are arranged in respective substantially vertical rows adjacent each lateral edge 15*a* and 15*b*.

Figure 6:
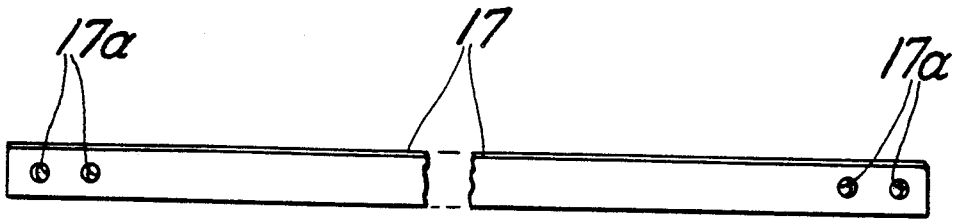
FIG. 6 is an upper perspective view of a support strap of the storage tank of FIG. 5.

The loops 16 are arranged to receive, in use, a plurality of support straps 17 as shown in FIG. 5. The support straps 17 are formed of elongated flexible flat metal straps having holes 17*a* in each end thereof, as shown in FIG. 6. Each support strap 17 is, in use, threaded through each of the horizontally corresponding loops 16, as shown in FIG. 5. It is intended that the support straps 17 be of such length as to enable them to be threaded through loops 16 of more than one panel member 11, such as a bank of 3 panel members 11. Thus, the straps 17 align and retain, in side by side overlapped manner, a number of panel members 11, such as 3 panel members 11.

Individual banks of panel members 11 are connected together by first overlapping their adjacent outer lateral edges 15*a* and 15*b* and securing corresponding straps 17 with bolt assemblies 18 arranged through the holes 17*a* of overlapping straps 17.

Any number of panel members 11 may be connected in this manner to form an endless wall storage tank 10. As is particularly shown in FIG. 2 the support straps 17 are not equally spaced over the height of the panel member 11. It has been found that an equal spacing of the support straps 17 results in an unequal distribution of load thereon imparted by an outward force due to the contents of tank 10. In particular it has been found that for a tank 10 comprising 6 support straps 17 equally spaced up the panel members 11 a large force acts against the second lowest support strap from the bottom of the tank (FIG. 5). The other support straps then have progressively less load the higher up the tank 10 they are situated.

Figure 2:
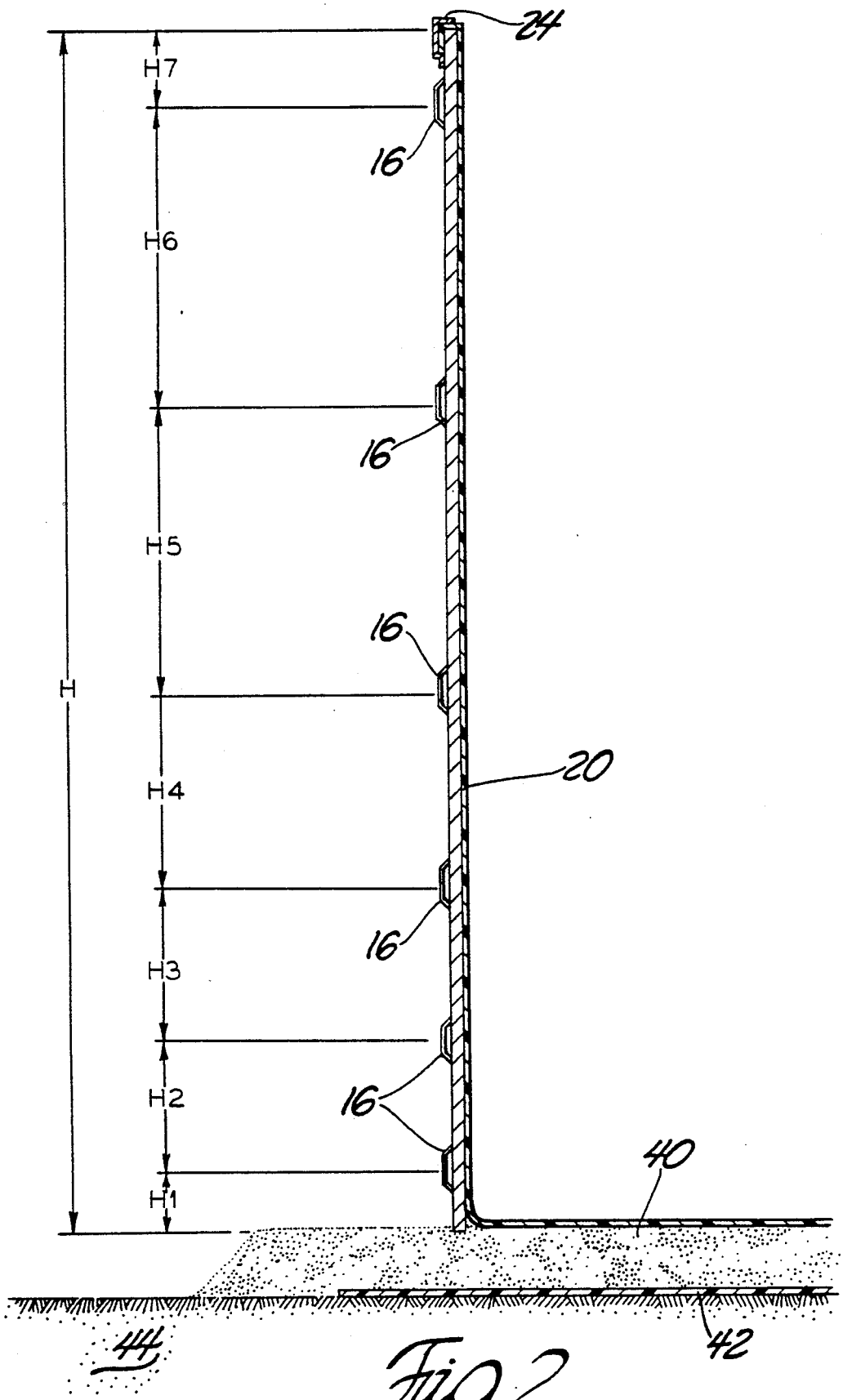
FIG. 2 is a side elevation of the panel member of FIG. 1, shown in situ.

It is preferred to maintain substantially equal load on each of the support straps 17 To accomplish substantially equal support strap loading more closely spaced straps 17 are required toward the lower end of the tank: 10. FIG. 2 shows an arrangement for 6 support straps 17 to achieve substantially equal distribution of load over the four support straps 17 located within the uppermost and lowermost support straps 17.

In the arrangement of FIG. 2 the uppermost and lowermost support straps 17 have substantially less load than the remaining support straps 17.

The height of the panel member 11 is designated H and the distance between adjacent support straps 17 is designated H1, H2, H3, H4, H5 and H6. The distance between the uppermost strap 17 and an uppermost edge of the panel member 11 is designated as H7. Typically the ratio of the panel height to the distance between adjacent support straps 17 is about 21 for $$\frac{H}{H1},$$

about 9.2:1 for $$\frac{H}{H2},$$

about 7.7:1 for $$\frac{H}{H3},$$

about 6.2:1 for $$\frac{H}{H4},$$

about 4.1:1 for $$\frac{H}{H5},$$

about 4.1:1 for $$\frac{H}{H6},$$

and about 15.6:1 for $$\frac{H}{H7}.$$

For a panel member height H of 2100 mm the support straps 17 are typically spaced such that H1 is about 100 mm, H2 is about 227 mm, H3 is about 273 mm, H4 is about 338 mm, H5 is about 510 mm, H6 is about 517 mm and H7 is about 135mm. It is envisaged that the ratio $$\frac{H}{H1}$$

be in the range of 14:1 to 21:1. That is, it is envisaged that the height H1 of the lowest strap 17 could be altered by up to about 50 mm. The preferred location of the support straps 17 is mainly dependent upon the height of the panel members 11. Thus, the ratios may be applied to produce a tank 10 of a different height with substantially even loading on the: support straps 17. However, it is to be understood that a scaling of the height and strap location of the tank 10 will result in corresponding scaling of the load bearing capability of the tank 10. For example, an increase in the height of the tank 10 will lead to a corresponding decrease in the load bearing capability of the straps 17 and the tank 10. In order to enable the tank 10 to store liquids, solids or powders of different densities it is generally only necessary to alter the support straps 17. For example, to enable the tank to store a dense liquid such as oil relatively stronger support straps 17 may be used than would be necessary in the storage of water or grain such as wheat.

When the tank 10 is used to store liquids the load on the support straps 17 is principally dependent on the head of water and the diameter of the tank 10. It is to be understood that the capacity of the tank 10 is also dependent on wind loading and wave formation (for stored liquids and bearing and shear forces on the soil and the like.

It follows that the load bearing capability of the tank 10 may be increased by increasing the size, gauge and yield strength of the support straps 17, the panel member 11 and the dimensional parameter of the tank 10 described herein. When the tank 10 is used to store solids or powders the load on the support straps 17 is principally dependent on the height of the solids or powders and the angle at which it will stack. That is, solids and powders can be substantially self supporting except for a periphery in which the solids or powders tend to slide under force of gravity. The angle of slope of the solids or powders at which no sliding occurs is called the stack angle.

The load due to solids or powders on the support straps 17 is only secondarily dependent on the diameter of the tank 10. Therefore, the capacity of the tank with respect to solids and powders for a given strength of support straps is substantially dependent on the height of the solids and powders. Thus, to increase the capacity of the tank 10 in respect of storage of solids and powders it is generally necessary only to increase the diameter of the tank 10 whilst maintaining the height of the tank 10 substantially constant. An important point to note in regard to the storage of solids and powders is that the load on the support straps 17 may not be constant. For example, where a tank 10 containing grain has some of the grain removed via an outlet located at the side of the tank 10 the load on the support straps 17 located opposite the outlet may be substantially greater than that near the outlet. Such non uniform loading of the tank 10 must be considered in determining the load capability of the tank. Thus, the actual capacity of the tank in respect of solids and powders is also dependent on the likely non uniform loading caused by the stacking effect of its contents It is to be understood that an even distribution of support straps 17 could be used. In such a case it is also understood that an evenly distributed arrangement of support straps 17 generally results in a lower load bearing capacity of the tank 10. It follows from this that relatively smaller tanks 10 could comprise such an arrangement of support straps 17.

The storage tank 10, in use, is intended to have a liner 20 formed of a resilient material such as a polyvinyl chloride plastics material or the like, as shown in FIGS. 2 and 5. Preferably, the liner 20 has resistance to U.V. light The liner 20 is intended to be located inside the storage tank 10 and secured to the top of each panel member 11 by a securing means 22.

The securing means 22 comprises a capping angle 24 and a plurality of securing plates 26. The capping angle 24 is laid, in use, on the wall of the tank 10 on top of the liner 20. The capping angle 24 is secured to the uppermost one of the support straps 17 by the securing plates 26 and thus secures the liner 20 in place. The capping angle 24 also provides an amount of rigidity to the upper reaches of the tank 10. Such rigidity may be necessary in situations when the tank 10 is substantially empty.

It is envisaged that patches may be required to cover the inside of the storage tank 10, at locations corresponding to the loops 16, to protect the liner 20.

The storage tank 10 may have a cover (not shown) positioned atop.

The cover may conveniently be formed of material similar to the liner 20.

The cover may be arranged so that substantially all of its area is in close proximity with a stored liquid. It is envisaged that a flotation means (not shown) would be useful to communicate the liquid level to the cover Thus, the cover could be maintained substantially at the same level as the liquid.

In this way the volume of air between the cover 22 and the liquid may be maintained as small as possible. It is desired to reduce the volume of air above the liquid to reduce the growth of algae and the like in the liquid It is further envisaged that the storage tank 10 could comprise a roof means (not shown) to seal its contents from the outside environment. The roof means could also be sealed to the capping angle 24 to render the tank 10 substantially air tight.

It is preferred that, in use, the raised ribs 14 and 15 of the panel member 11 be disposed inwardly of the storage tank 10. It has been found that such an arrangement has preferable features compared to an arrangement with outwardly disposed ribs In particular, it results in a more evenly distributed outward force on the panel members 11 and on the support straps 17. Such even distribution of force occurs since the support straps 17 contact the flat portions 12 of the panel members 11.

If the raised ribs 14 and 15 extend outwardly of the storage tank 10 the support straps 17 may be drawn through slots 16 in the raised ribs 14 and 15. Such an arrangement is not preferred since the plurality of slots 16 result in much friction in drawing the straps 17 therethrough. Also, in use, such an arrangement would result in deformation of flat portions 12 of the panel members 11 under the force of the contents of the tank 10.

Also, the preferred arrangement yields less stretch on the liner 20 about the raised ribs 14 and 15 when the storage tank 10 has a store of liquid or solids or powders, such as water, grain or cement powder. That is, since the raised ribs 14 extend inwardly of the storage tank 10 the liner 20 is not forced into the raised ribs 14 and 15 and so is not subjected to as much stretching as otherwise may occur. In use, an unassembled tank 10 is taken to a desired location and a number of panel members 11, such as 3 panel members 11, are laid in side by side arrangement with adjacent raised ribs 15 overlapped.

Then the support straps 17 are threaded through horizontally corresponding loops 16 of the overlapped panel members 11. Once the straps 17 are threaded the bank of panel members 11 are stood up and the bank bent to a desired amount of curvature. The amount of curvature desired is that which will ultimately yield a storage tank 10 of desired radius once a plurality of banks are secured together. The banks are secured together by the bolt assemblies 18, shown in FIG. 5, engaged with the holes **17*a* (FIG. 6) of overlapping straps 17**.

When the wall of the storage tank 10 is completed, by the bolting together of the first and the last panel members 11, the liner 20 and the roof may be placed in and on the storage tank 10.

It has been found that a support base is not essential in supporting the apparatus of the present invention, as the outward force of the stored substance is usually sufficient to prevent sinkage of the panel members 11 into the ground. However, it is to be understood that a lip may be formed on the lower edge of the panel members 11 to further assist in the vertical support of the storage tank 10.

Preferably, the storage tank 10 is to be erected on a bed of dense sand 40 spread over a permeable underlay 42 on top of the ground 44 as shown in FIGS. 2 and 5. It has been found that sinkage of the panel member 11 is least likely when erected on a dense sand 40 rather than a clay based soil 44. Further, the permeable underlay 42 is preferred to reduce the occurrence of the dense sand 40 combining with the lower soil 44. Also, if the liner 20 develops a leak the underlay 42 will allow a liquid stored in the tank 10 to flow away substantially without errosion of the dense sand 40.

If an underlay 42 is not used it is predicted that a leak could cause considerable errosion of the supporting sand 40 and ground 44 and could result in the collapse of the tank 10.

If the storage volume of the storage tank 10 is to be increased or reduced one may effect such a change by respectively adding or removing panel members 11 or banks of panel members 11 and support straps 17.

It is envisaged that the tank 10 of the present invention could comprise inlet means and outlet means for entry and exit of the substances stored therein.

Also, it is envisaged that the tank 10 could be adapted, with the addition of doors and the like and the deletion of the liner 20, as a dwelling. The dwelling could require some form of insulation and/or ventilation. Modifications and variations such as would be apparent to a skilled addressee are deemed within the scope of the present invention. For example, panel members 11 of a shape other than that described hereinabove could be used provided the straps 17 could still retain the panel members 11 secured in side by side alignment.

Further, the plurality of panels 11 could be replaced by a single sheet of ribbed material curved around so that its ends overlap to form the endless wall of the storage tank 10. Also, it is envisaged that the lower reaches of the storage tank 10 would be coated with a corrosion resistant substance such as polyurethane.

Also, panel members 11 of a width other than 1200 mm could be used and thus may require ratios other than those mentioned hereinabove.

I claim:

1. A storage tank comprising:

(a) an endless wall formed of a plurality of panel members each having:

(i) one or ore generally flat portions of single skin thickness;

(ii) a first lateral edge and a second lateral edge opposite said first lateral edge;

(iii) a plurality of upright raised ribs each located laterally of said one or more flat portions, all of said upright raised ribs projecting in the same direction from the or each said generally flat portion; and (iv) one or more integral loops formed from two substantially parallel slits made in the single skin of said generally flat portions and having intervening material between the slits deformed in a direction opposite to that of the upright raised ribs;

(b) at least one endless support strap being substantially flat and elongated and extending substantially horizontally around said endless wall and disposed through and retained by a plurality of said loops to retain and align adjacent panel members in vertical and side by side overlapped relation and to provide support to said endless wall, the retention of the or each endless support strap in said loops providing restraint for adjacent panel members to substantial relative immobility and said loops having an aperture substantially equal in cross-sectional dimension to the cross-sectional dimension of said endless support strap it is to retain, said first and second lateral edges of said adjacent panel members being devoid of means to positively fix them together.

2. A storage tank according to claim 1 in which one of said upright raised ribs is located adjacent said first lateral edge and another of said upright raised ribs is located adjacent said second lateral edge, said panel members being disposed in overlapping manner with said upright raised rib adjacent said first lateral edge of one of said panel members being cupped by said upright raised rib adjacent said second lateral edge of an adjacent one of said panel members, the cupping of the said upright raised ribs being the sole engagement between adjacent panel members and at least one of said endless support strap retaining and aligning adjacent panel members in vertical and cupped overlapped relation.

3. A storage tank according to claim 2 in which each panel member has at least two of said loops disposed at equal heights on said panel members in order to receive one of said endless support straps.

4. A storage tank according to claim 2 in which each panel member has at least two of said loops disposed at equal heights on said panel member in order to receive one of said endless support straps, wherein one of the said at least two loops is located adjacent said first lateral edge and one other of the said at least two loops is located adjacent said second lateral edge.

5. A storage tank according to claim 2 in which each endless support strap is disposed about the endless wall and contiguous with said flat portions of said panel members.

6. A storage tank according to claim 2 in which each endless support strap is formed of a plurality of support straps extending through said loops of a plurality of said panel members so as to retain and align said panel members in side by side cupped overlapped relation.

7. A storage tank according to claim 2 in which each endless support strap is formed of a plurality of support straps joined end to end, wherein each of said support straps extends through the loops of a plurality of said panel members in side by side cupped overlapped relation and where adjacent support straps of each endless support strap are connected at or adjacent throughs created by said upright raise ribs.

8. A panel member comprising:

(i) one or more generally flat portions of single skin thickness;

(ii) a first lateral edge and a second lateral edge opposite said first lateral edge;

(iii) a plurality of upright raised ribs each located laterally of one or two flat portions, all of said upright raised ribs projecting in the same direction from the or each generally flat portion; and (iv) one or more integral loops formed from two substantially parallel slits made in the single skin of said generally flat portions and having intervening material between the slits deformed in a direction opposite to that of said upright raised ribs; said loops being disposed to receive and retain at least one substantially flat and elongated endless support strap to retain and align adjacently placed panel members in vertical and side by side overlapped relation, the retention of the or each endless support strap in said loops providing restraint for adjacent panel members to substantial relative immobility of said loops having an aperture substantially equal in cross-sectional dimension to the cross-sectional dimension of said endless support strap it is to retain, said first and second lateral edges of said panel member being devoid of means to positively fix same to the said adjacently placed panel member in use.

9. A panel member according to claim 8, in which one of said upright raised ribs is located adjacent said first lateral edge and another of said upright raised ribs is located adjacent said second lateral edge, the sole means of engagement provided between said panel member and said adjacently placed panel member being cupping of said upright raised rib adjacent said first lateral edge of said panel member with said upright raised rib adjacent said second lateral edge of said adjacently placed panel member.

10. A panel member according to claim 8, in which at least two of said loops are disposed at equal heights on said panel member in order to receive one of said endless support straps.

11. A panel member according to claim 10 in which one of the said at least two loops is located adjacent said first lateral edge and one other of the said at least two loops is located adjacent said second lateral edge.

12. A storage tank comprising:

(a) an endless wall formed of a plurality of panel members each having:

(i) one or more generally flat portions of single skin thickness;

(ii) a first lateral edge and a second lateral edge opposite said first lateral edge;

(iii) a plurality of upright raised ribs each located laterally of one or two flat portions, one of said upright raised ribs being located adjacent said second lateral edge, all of said upright raised ribs projecting in the same direction from the or each generally flat portions; and (iv) one or more integral loops formed in or fixed to said generally flat portions and projecting in a direction opposite to that of said upright raised ribs;

said panel member disposed adjacent relative to one another and in overlapping manner; and (b) at least one endless support strap being substantially flat and elongated and extending substantially horizontally around said endless wall and disposed through a plurality of said loops to retain and align adjacent panel members in vertical and side-by-side overlapped relation and to provide support to said endless wall, said upright raised rib adjacent said second lateral edge of an adjacent one of said panel members, said upright raised ribs and the retention of the or each endless support strap in said loops providing restraint for adjacent panel members to substantial relative immobility and said loops having an aperture substantially equal in cross-sectional dimension to the cross-sectional dimension of said endless support strap it is to retain, said first and second lateral edges of adjacent panel members being devoid of means to positive fix them together.

* * * * *

UNITED STATES PATENT AND TRADEMARK OFFICE

CERTIFICATE OF CORRECTION

PATENT NO. : 4,989,751

DATED : February 5, 1991

INVENTOR(S) : Graham Gillett

It is certified that error appears in the above-identified patent and that said Letters Patent is hereby corrected as shown below:

ON TITLE PAGE:

Item [73] after "Assignee" delete INTERLOK LIMITED, AUSTRALIA and insert therefor - - CREEKS METAL INDUSTRIES PTY LTD - -

Signed and Sealed this

Twenty-ninth Day of September, 1992

*Attest:*

DOUGLAS B. COMER

*Attesting Officer*

*Acting Commissioner of Patents and Trademarks*